US005791691A

United States Patent [19]

Charles, Jr.

[11] Patent Number: 5,791,691

[45] Date of Patent: Aug. 11, 1998

[54] MEDICAL ENCOUNTER FORM

[76] Inventor: Lloyd M. Charles, Jr., 10805 Landtree Dr., Croom, Md. 20773

[21] Appl. No.: 787,164

[22] Filed: Jan. 23, 1997

[51] Int. Cl.[6] ..... B42D 11/00

[52] U.S. Cl. ..... 283/66.1; 283/115

[58] Field of Search ..... 283/72, 66.1, 115, 283/900; 462/22

[56] References Cited

U.S. PATENT DOCUMENTS

| | | | |
|---|---|---|---|
| 3,661,407 | 5/1972 | Warren | 283/66.1 |
| 5,088,961 | 2/1992 | Sprain | 283/66.1 X |
| 5,413,383 | 5/1995 | Laurash et al. | 462/22 X |

*Primary Examiner*—Willmon Fridie, Jr.
*Attorney, Agent, or Firm*—Richard C. Litman

[57] ABSTRACT

A medical encounter form, and a method for simultaneously recording pertinent patient and financial information onto patient encounter forms and onto a medical provider maintained daily log, for improving a medical provider's ability to minimize inconsistencies and validate entries. The medical encounter form comprises three sheets: a master sheet for recording data, a second sheet for duplicate copy, and a specialized third sheet for ink transfer to an underlying surface. The master sheet is provided with a pressure-sensitive inked back side for making a duplicate copy of varying data onto the second sheet. The face of each such sheet includes a columnar preprinted area for entry of patient examination information and aa preprinted row including areas for printing information regarding the fee for services rendered. The zone transfer sheet is limited to having a narrow strip of pressure sensitive image-reproductive material on its back side. The three sheet form is overlain a data log sheet on a ledger board by manually aligning a pin-feed edge over the pegs of the ledger board, aligning the fee for services rendered line on the next available daily log sheet entry line. The image-reproductive strip on the back side of the third sheet is exposed to the face of the underlying daily log sheet, allowing pressure exerted by a writing instrument to simultaneously transfer the information written in the fee for services line to the daily log entry line, creating three record copies simultaneously.

7 Claims, 2 Drawing Sheets

MEDICAL ENCOUNTER FORM

CROSS-REFERENCE TO RELATED APPLICATION

This application claims the benefit of U.S. Provisional Pat. Application Ser. No. 60/010,620, filed Jan. 26, 1996.

BACKGROUND OF THE INVENTION

1. Field of the Invention

The present invention relates to a medical form, and a method of use thereof, for maintaining a patient's visit, billing, and demographic information while simultaneously updating the daily log of the medical practitioner.

2. Description of Prior Art

With the advent of social reform programs in the area of medical care and treatment, medical care is presently available to everyone regardless of his ability to pay for the services he receives. However, in order for a medical provider to receive payment from sources other than the patient, such as insurance carriers, or governmental agencies, necessary forms must be submitted to the paying agency, which will then, upon approval, remit payment to the medical provider. As a result, medical providers have encountered an increased number of problems associated with accounting and bookkeeping relating to the services performed.

The forms which are submitted for payment usually must include such information as the name and address of the individual who received the services, the cost of the services, the nature of the treatment and/or prescription received, and the name and address of the provider rendering the services. A series of universally accepted codes has been established for nearly all medical diagnoses and procedures, which are commonly used on such forms to minimize processing time by both the medical provider and payer. The forms usually provide a list of preprinted codes, which the medical provider may then conveniently mark manually and input the appropriate fees for the services.

However, a bookkeeping problem arises when using such forms. Other supplementary and different record keeping requirements imposed from other sources, such as compliance requirements of the Internal Revenue Service, payroll recording requirements, and generally tracking business financial records, are not easily coordinated with payment forms. In a typical medical office, a medical provider is forced to duplicate and transfer the entire record and financial information concerning a patient visit to a separate daily ledger or log. Unless the medical provider has a reliable means for corroborating that a transfer of the entries from the payment form to the daily log has been correctly made, or documented at all, he cannot be certain that the correct financial information has been transcribed onto the daily ledger. As a result, inconsistencies between entries in each of the two recording systems may arise from unintentional human errors in transcription from the form to the daily log, as well as, from patient fraud by duplication or alteration of previously obtained receipts and encounter forms, or even from employee fraud, e.g., when a patient receives a valid receipt for a cash payment, but the medical provider employee enters no record of payment into the log. Such inconsistencies result in unnecessary cost to a medical provider.

Therefore, a need exists for a means and a method of verifying entries between recording systems using preprinted forms. Numerous inventions concerning the need to simplify medical forms, as well as to improve bookkeeping procedures, are known. For instance, U.S. Pat. No. 5,188,563, issued to Hanauer makes use of a strategically placed carbon strip to transfer certain information to the bottom sheets of the form. Likewise, U.S. Pat. Nos. 3,960,634, issued to Kempster, 3,913,118, issued to Abrams, 4,029,341, issued to Neill et al., 4,062,568, issued to Schrantz et al., 4,221,404, issued to Shuffstall, 4,295,664, issued to Cutting, 5,171,039, issued to Dusek, all disclose forms for recording information independent of the log entry of the provider.

None of the above inventions and patents, taken either singly or in combination, is seen to describe the instant invention as claimed.

SUMMARY OF THE INVENTION

The present invention is a medical encounter form and a method for simultaneously recording pertinent patient and financial information onto patient encounter forms and onto a medical provider maintained daily log, thereby improving a medical provider's ability to minimize inconsistencies and validate entries. The medical encounter form comprises three sheets: a master sheet for recording data, a second sheet for duplicate copy, and a specialized third sheet for ink transfer to an underlying surface.

The master sheet is provided with a pressure-sensitive inked back side, well known in the prior art, for making a duplicate copy of varying data on the second sheet. Accordingly, the master sheet and second sheets have identical preprinted faces. The face of each such sheet includes three distinct areas: 1) a preprinted area, defined by columnar listings of diagnostic and treatment services and related codes, as well as relevant business information identifying the medical practitioner, 2) a blank area for printing patient demographic and financial information, and 3) a preprinted row including areas for printing information regarding the fee for services rendered (herein the "fee for services line").

The third sheet is a zone transfer sheet, blank on its face and limited to having a narrow strip of pressure sensitive image-reproductive material on the back side, the strip corresponding in width to the width of the preprinted fee for services line. The three sheets are stacked and aligned, each face forward, such that the fee for services line of the master and second sheets and the strip of reproductive material are in registry with one another.

To maintain the stack of three sheets, the stack is preferably adhesively bound along each of the sheets as necessary to prevent disattachment from one another. The stack is further provided with removable pin-feed edge strips, for use with a computer printer and for ease of alignment of the form onto a pegged ledger board.

To use the form, a medical provider first accesses the demographic information of the patient from a computer database, feeds the form into an associated printer and prints the information on the form in the blank area. After a medical practitioner has examined the patient, the practitioner manually marks the form in the preprinted area to indicate the rendered standard diagnostic services and associated codes and fees. The pegged ledger board then receives a conventional daily log sheet, which provides vertically aligned rows as entry spaces for sequentially listing financial transaction information for each day. The form according to the present invention is overlain by manually aligning the pin-feed edge over the pegs of the ledger board, aligning the fee for services rendered line on the next available daily log sheet entry line.

The image-reproductive strip, being on the back side of the third sheet, is exposed to the face of the underlying daily log sheet, and allows pressure exerted by a writing instrument to simultaneously transfer the information written in the fee for services line to the daily log entry line. Thus, the financial information for the instant visit is properly transcribed, rendering a master copy, a second duplicate copy and a daily log entry via the narrow strip of reproductive material on the back side of the zone transfer sheet. Thus, the medical practitioner can with one transcription, maintain clear and accurate records of his patient encounters and the daily financial records necessary for the medical practice.

Accordingly, it is a principal object of the invention to provide a form for use with a daily log which eliminates the need for transcription of information an original medical form to a daily log sheet.

It is another object of the invention to provide a form that is compatible with both a printer and a daily log sheet ledger board.

It is a further object of the invention to provide a plurality of forms in a standard fan-fold disposition until needed or retrieved for printing or transcription.

Still another object of the invention is to provide a method of medical encounter record keeping for medical provider use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
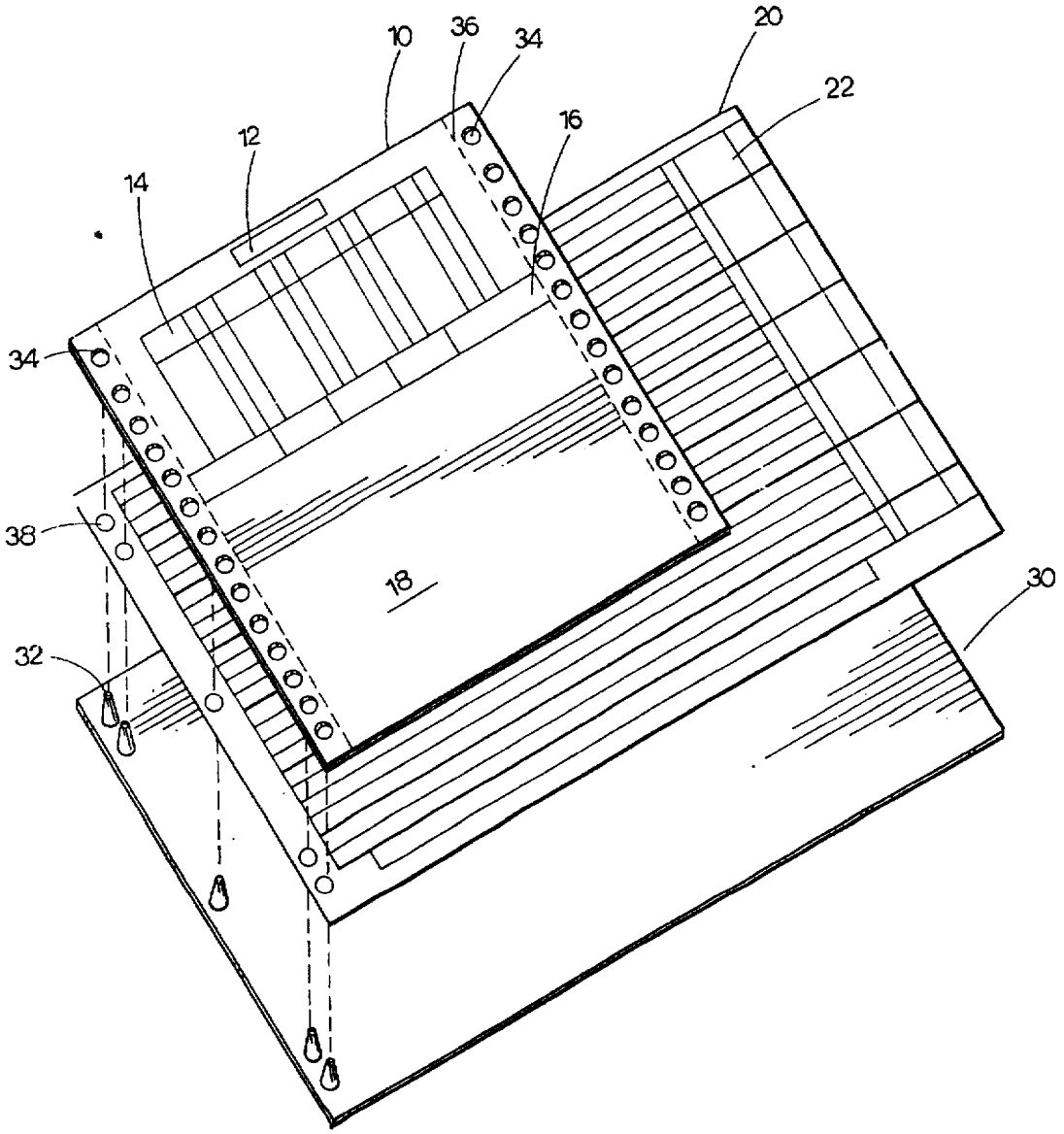
FIG. 1 is an exploded perspective view of the form of the present invention in a state of use with a pegged ledger board and a daily log sheet.
Figure 2:
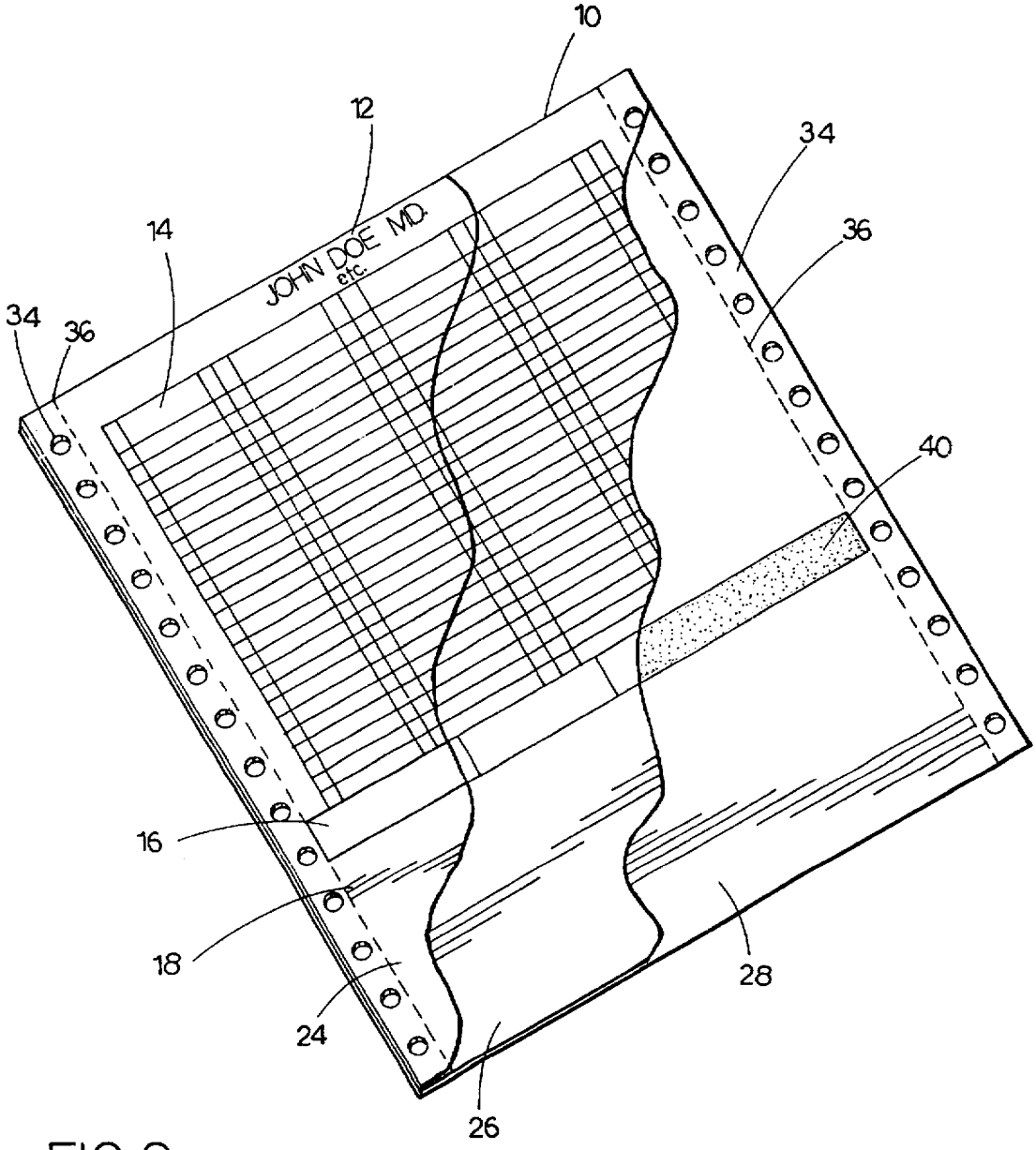
FIG. 2 is a cutaway perspective view of the form of the present invention.

Referring to FIGS. 1 and 2 together, the medical encounter form 10 of the present invention can be understood to be cooperatively used with a standard daily ledger or log sheet 20, which is carried on a ledger board 30. The medical encounter form 10 comprises three sheets: a master sheet 24 providing preprinted data for recordation of patient examination information, a second sheet 26 for duplicate copy of the master sheet 24, and a specialized third sheet 28 for ink transfer to an underlying surface.

Generally described, the master sheet 24 and the second sheet 26 have identical indicia (12, 14, and 16) permanently imprinted thereon. The sheets 24,26 are aligned and stacked so that the indicia of the master sheet 24 overlies the indicia of the second sheet 26. The master 24 and second 26 sheets are releasably adhesively attached, by any suitable means as may be well known in the prior art. The master sheet 24 is further provided with a pressure-sensitive inked back side, well known in the prior art, for making a duplicate copy of varying data entered onto the master sheet 24 onto the second sheet 26. One such conventionally known means includes the application of a layer of microcapsules of ink to the back side of the master sheet 24, which allow an instantaneous copy on the second sheet 26 of a firm impression on the master sheet 24. It is also evident that the microcapsules may instead be incorporated in a layer on the front side of the second sheet 26. Moreover, it is also well known to provide a layer of microcapsules on both the back side and face of a sheet, which means may be applied to back side of the master sheet 24 and the front side of the second sheet 36, wherein the microcapsules contain two reactants which when mixed (i.e., upon the application of pressure on the front side of the master sheet 24) produce ink or other marking substance.

With regard to the grouping of printed indicia, the face of each sheet includes three distinct areas, provided with alphamumeric indicia, the content of which complies with all rules and regulations for medical forms of such type. In a first preprinted area, listings of diagnostic and treatment services and related codes and relevant business information identifying the medical practitioner are provided. In the preferred embodiment, the medical encounter form 10 has a first area 12 at the head of the master sheet 24 and second sheet 26 defined by permanently imprinted indicia identifying the medical practitioner by name, address, and telephone. Also, the medical encounter form 10 has area 14 of permanently imprinted indicia listing, in columnar format, the general services rendered by the identified medical practitioner 12, likewise provided on both master sheet 24 and second sheet 26.

A blank area for printing patient demographic and financial information is provided on the master and second sheets. In the preferred embodiment, region 18 is shown near the bottom of each sheet, which is used by the medical practitioner for printing (e.g., from a PC or other type database) demographic, history, insurance, and financial information regarding the patient.

Separating region 18 from area 14 is a preprinted row, including areas for printing information regarding the fee for services rendered, namely, the "fee for services line" or section 16. Indicia and blank areas form a generally sectioned line, each section being identified to address the total charges, credits, and balances for the patient upon completion of a visit. The fee for services line 16 may also include a further section for identifying the patient.

The third sheet 28 provided in the preferred embodiment is cheeseskin or onionskin type paper, and is used as a zone transfer sheet. The zone transfer function can be accomplished by applying to the back side of third sheet 28 a narrow strip 40 of a pressure sensitive image-reproductive material. The preferred material generally is known as carbon, or carbon transfer ink. Other types of transfer materials (such as microcapsules of ink) are also suitable. The front side of the third sheet 28 is likewise, releasably adhesively attached to the back side of the second sheet.

The medical encounter form 10 is designed to be accommodated by any conventional dedicated, multi-use type, impact printer having a continuous type carriage feed. On the lateral edges of the medical encounter form 10 are a pair of edge strips 34, that are separable from the medical encounter form 10 by conventional perforations 36. The edge strips 34 are conventionally known and have aligned holes that cooperate with the conventional printers. Moreover, it is conventional to provide a plurality of the medical encounter forms 10 in a fan-fold manner connected in sequence across the respective top and bottom edges by a commonly accepted perforation. Thus, continuous feed of the medical encounter forms 10 through a printer for each individual patient that has demographic information stored in a PC. The preferred embodiment has been disclosed as a medical encounter form 10 having three sheets. However, it is well within the art to provide additional sheets in a manner consistent with the master sheet 24 and the second sheet 26, for producing additional copies of the transcribed information on the master sheet 24.

Although conventional to provide holes of edge strips 34 for printing purposes, the form 10 provides the added advantage that the edge strips 34 can be aligned upon the ledger board 30, thus allowing the transfer zone ink strip 40 of the third sheet 28 to be directly laid in contact with and overlay the ledger sheet 20 such that the ink strip 40 aligns with an entry line of the ledger sheet.

The advantage of such form is apparent from the following described applied use of the form. A medical practitioner typically has several patient appointments scheduled for each day of operation. The medical practitioner, prior to examination of the patient, prints relevant information regarding each scheduled patient on a respective medical encounter form 10, thus defining a partially completed form. Next, during examination of the patient, the partially completed form is available to the examining medical practitioner, who makes the necessary markings or inclusions on the section 14 of the medical encounter form 10 regarding his diagnoses, procedures and treatment fees (thereby defining a nearly completed form). Upon completing the examination, the nearly completed form is usually submitted to a staff member, who then aligns the fee for services line 16 over a blank corresponding line 22 on the daily log sheet 20. The holes of the edge strips 34 receive the pegs 32 on the ledger board 30, which maintain the log sheet 20 on the ledger board 30 and aid in aligning the fee for services line 16 on the medical encounter form 10 with the line 22 on the log sheet 20. So aligned, the nearly completed form 10 is ready for the staff member to transcribe the billing information from the medical practitioner as recorded in section 14 to the fee for services line 16. The services rendered, along with updated financial accounting of the patient, is thus transcribed a single, one-time transcription onto three individual sheets. As a result, the medical practitioner has a record of the services and billing information rendered to each individual patient by virtue of a completed form 10, as well as an accurate entry of financial transactions carried out for each individual patient on the daily log sheet 20. Discrepancies in financial records are virtually eliminated. The system and method provide a self-check and a cross-check of the financial data gathered for the medical practitioner. Finally, the second sheet 26 of the medical encounter form 10 provides the patient with adequate information concerning the services received, serves as a receipt for payment and as a statement reflecting any outstanding balances.

It is to be understood that the present invention is not limited to the sole embodiment described above, but encompasses any and all embodiments within the scope of the following claims.

I claim:

1. A medical encounter record keeping package for medical practitioner use comprising:

a master sheet, having a front side and a back side, said front side of said master sheet including a first set of printed indicia for identifying a medical practitioner, diagnostic services, and associated codes, defining a plurality of columns, a second set of printed indicia for identifying a fee-for-services line defining a row of predetermined width and length, and a blank area for receiving indicia of individual patient history, financial, and demographic information;

a second sheet, having a front side and a back side, said front side of said second sheet being releasably adhesively attached to said back side of said master sheet, and said front side of said second sheet including the same first set of printed indicia and second set of printed indicia, both sets identically aligned with the master sheet when overlaying the second sheet;

pressure sensitive inking means for duplicating impressions caused on said master sheet onto said second sheet; and, a third sheet, having a front side and a back side, said front side of said third sheet being releasably adhesively attached to said back side of said second sheet, said back side of said third sheet having a pressure sensitive transfer strip disposed across substantially the entire diameter of said third sheet, said transfer strip being dimensioned substantially the same as the predetermined width and length of said row, said transfer slip aligned in registry therewith.

2. The medical encounter record keeping package according to claim 1 wherein said pressure sensitive inking means include microcapsules of ink.

3. The medical encounter record keeping package according to claim 1 further including:

a removable perforated edge strip on a lateral side of said master sheet, said second sheet and said third sheet.

4. A system for keeping medical records, using the medical encounter record keeping package according to claim 1, the system comprising:

a computer operated pin-feed impact printer; and, a plurality of medical encounter record keeping packages being separably coupled to one another for allowing continuous feeding of each of said packages through said pin-feed impact printer.

5. A method of medical encounter record keeping comprising the steps of:

providing a master sheet, having a front side and a back side, said front side of said master sheet including a first set of printed indicia for identifying a medical practitioner, diagnostic services, and associated codes, each defining a plurality of columns, further including a second set of printed indicia for identifying a fee-for-services line defining a row of predetermined width and length, and further including a blank area for receiving indicia of individual patient history, financial, and demographic information;

providing a second sheet, having a front side and a back side, said front side of said second sheet including the same first set of printed indicia and second set of printed indicia, releasably attaching said second sheet to said back side of said master sheet so that both sets are identically aligned with the master sheet when overlaying the second sheet;

providing pressure sensitive inking means for duplicating impressions caused on said master sheet onto said second sheet between said master sheet and said second sheet;

providing a third sheet, having a front side and a back side, said back side of said third sheet;

providing a pressure sensitive transfer strip disposed across substantially the entire diameter of said third sheet, said transfer strip being dimensioned substantially the same as the predetermined width and length of said row, said transfer slip aligned in registry therewith;

releasably attaching said third sheet to said back side of said second sheet;

placing each said master, second, and third sheets together on a data log entry sheet, the data log entry sheet having a plurality of record lines;

aligning the fee-for-services record line with a blank data log entry sheet record line; and, causing an impression of written indicia on the master sheet on the fee-for-services record line;

whereby causing an impression simultaneously provides a copy on the fee-for-services record line of the master sheet, the second sheet and the corresponding data log entry sheet record line.

6. The method according to claim 5, further comprising the step of:

providing removable perforated edge strips on each side of the master, second and third sheets for continuous feeding the master, second and third sheets simultaneously together through a printer.

7. A method of medical encounter record keeping for medical practitioner usage according to claim 6, further comprising the steps of:

providing a plurality of aligned master, second, and third sheets, each of the plurality of aligned master, second, and third sheets having a top edge and a bottom edge, the bottom edge of a first aligned master, second, and third sheets of the plurality of aligned master, second, and third sheets being separably coupled to the top edge of a next aligned master, second, and third sheets of the plurality of aligned master, second, and third sheets;

providing each subsequent bottom edge of each next aligned master, second, and third sheets of the plurality of aligned master, second, and third sheets being separably coupled to each subsequent top edge of each next aligned master, second, and third sheets of the plurality of aligned master, second, and third sheets, thereby the edge strips of each aligned master, second, and third sheets of the plurality of aligned master, second, and third sheets providing continuous guiding of the plurality of aligned master, second, and third sheets through the printer.

* * * * *